US005803497A

United States Patent [19]

Suess

[11] Patent Number: 5,803,497

[45] Date of Patent: Sep. 8, 1998

[54] CARD CALENDAR

[75] Inventor: Sharon B. Suess, Halcottsville, N.Y.

[73] Assignee: Cullman Ventures, Inc., Norwalk, Conn.

[21] Appl. No.: 618,129

[22] Filed: Mar. 19, 1996

[51] Int. Cl.[6] ..... B42D 5/04

[52] U.S. Cl. ..... 283/2; 40/107

[58] Field of Search ..... 283/2–4; 281/45, 281/2–4; D19/20, 21; 40/107; 273/303, 306; 229/240; 206/751, 737, 45.24, 45.25; D21/42–47

[56] References Cited

U.S. PATENT DOCUMENTS

| | | | |
|---|---|---|---|
| D. 168,394 | 12/1952 | Carpenter | D21/42 |
| 266,444 | 10/1882 | Dreyfuss . | |
| D. 311,025 | 10/1990 | Bermack | D19/21 |
| 1,549,645 | 8/1925 | Windfuhr | 206/45.24 |
| 1,559,813 | 11/1925 | Van Benthuysen | 273/306 |
| 1,939,824 | 12/1933 | Mix et al. | 206/44 |
| 2,284,256 | 5/1942 | Benrath | 273/152 |
| 2,845,732 | 8/1958 | Nichols | 40/152.1 |
| 2,889,036 | 6/1959 | Davies | 206/45.2 |
| 4,147,363 | 4/1979 | Lee et al. | 273/304 |
| 5,259,132 | 11/1993 | Leonard | 40/107 |

FOREIGN PATENT DOCUMENTS

| | | | |
|---|---|---|---|
| 344411 | 6/1904 | Germany | 206/45.24 |
| 703281 | 3/1941 | Germany | 283/4 |

OTHER PUBLICATIONS

Wabster's New International Standard Unabridged Dictionary, p. 2163, definition of "Roman Calendar", Dec. 1940.

Jacobs Gardner Office Supply Catalog, p. 336, item E, "Date Center Calendar Refill", Dec. 1990.

1935 30th Anniversary GEMACO Brochure.

*Primary Examiner*—Willmon Fridie, Jr.

*Attorney, Agent, or Firm*—Trapani & Molldrem

[57] ABSTRACT

A card calendar is disclosed which includes a set of cards in the form of a deck of playing cards. Each card includes indicia identifying the suit and rank of the card as well as calendar information for one week of the calendar year. A container is provided for the set of cards which can be converted from a closed configuration in which it encloses the set of cards for storage to an open configuration in which the container is adapted to support the cards in a position to display the calendar information on the cards.

1 Claim, 3 Drawing Sheets

CARD CALENDAR

BACKGROUND OF THE INVENTION

1. Technical Field

The present invention relates to calendars, and more particularly, to a calendar of the type in which information for a calendar is displayed on a set of playing cards.

2. Background Art

Calendars have long been used as a medium for advertising and promotion. Trade names, trademarks, addresses, telephone numbers, and logos have been printed on wall and desk calendars for many years. This medium is advantageous because the advertisement or promotion usually remains visible for the entire calendar year. However, one disadvantage of using a conventional calendar as a medium for advertisement is that it becomes outdated after the calendar year has passed. As a result, the calendar is normally discarded along with the advertisement. A need therefore exists for extending the useful life of an advertisement or promotion printed on a calendar. The present invention fulfills this need by providing an alternative use for the calendar, which use remains after the calendar year has long since passed.

Playing cards have also been used as a medium for advertisement or promotion. Advertisements, logos, etc. have been printed on the front and rear faces of standard decks of cards. One example of such use is disclosed in U.S. Pat. No. 266,444 to Dreyfuss. This medium has a disadvantage in that the cards are not continuously on display, like a wall or desk calendar. Rather, they are normally stored away until someone desires to play a game of cards.

The present invention overcomes the above-mentioned disadvantages of both the calendar and playing card mediums by combining these two mediums into one—a playing card calendar.

Various calendars are known in which calendar information is contained on a set of cards. Examples of such calendars are disclosed in U.S. Pat. Nos. 5,259,132 to Leonard and Des. 311,025 to Bermack. The design patent to Bermack shows the days of a month printed on a set of card elements. While the cards seem to function, in part, as a puzzle, they do not comprise a standard deck of playing cards. Moreover, Bermack does not suggest that playing cards can be combined with an advertisement or promotional calendar to extend the life of an advertisement or promotion. The patent to Leonard discloses a daily calendar printed on card "pieces"; however, the card pieces are not configured as playing cards, and do not serve any function other than to display calendar information. U.S. Pat. No. 2,284,256 to Benrath disclose a set of twelve cards each one of which indicates a month of the calendar year. However, this set of cards does not function as a calendar.

In choosing among the various advertisement and promotional mediums, key considerations include the amount of space available for the advertisement or promotion, display time ("air time"), and the durability of the medium. It is important to maximize the exposure (or visibility) of the advertisement or promotion. With continuously displayed wall or desk calendars, the adverting space is generally limited to the front face of the calendar's backing or frame, or on the face of the calendar sheets themselves. Calendars are normally printed on sheets of paper, bound together. The paper sheets are not as durable as cardboard or other rigid material. Therefore, the paper sheets of the calendar are not an ideal medium for the advertisements. In addition, you will rarely see advertisements on the front and back of a paper calendar sheet.

U.S. Pat. No. 2,284,256 to Benrath discloses playing cards as a durable medium for advertisements which are printed on the front and back of the cards. However, as mentioned above, cards, alone, are not as effective a medium as a calendar that is continuously displayed.

There still exists a need for increasing the advertising space to provide the most effective advertising medium.

The present invention has fulfilled this need by employing calendar cards, a combination display and storage case for the cards, and "special cards," all of which contain space for advertising and promotion.

OBJECTS AND SUMMARY OF THE INVENTION

It is therefore an object of the present invention to provide a card calendar that overcome the problems associated with the prior art.

It is another object of the present invention to provide a card calendar which is particularly suitable for use on a table or desk.

It is a further object of the present invention to provide a card calendar suitable for advertisement and promotional purposes.

It is yet another object of the present invention to provide a card calendar for advertisement and promotional purposes, having means to extend the useful life of the advertisement or promotion beyond the year represented by the calendar.

It is yet a further object of the present invention to provide a card calendar for advertisement and promotional purposes which offer increased opportunities for displaying the advertisement or promotion over conventional calendars of comparable size.

It is still another object of the present invention to provide a card calendar having a set of cards which are adapted to be displayed in a simple, inexpensive holder.

It is a still further object of the present invention to provide a container for a card calendar which can be used for both storing and displaying the cards.

It is yet still another object of the present invention to provide a card calendar which can also function as a deck of playing cards.

These and other objects are obtained in accordance with the present invention wherein there is provided a calendar in the form of a set of fifty-two cards. Information for one week of the calendar year is included on the face of each of the cards. In one embodiment of the present invention, indicia for a playing card are also included on the face of each card, and the fifty-two cards in the set can function as a deck of playing cards as well as a card calendar. Advertising matter can be placed on the front and/or back side of each card.

A container is provided for the set of cards which can be converted from a closed box configuration or position to an open display case configuration or position. The container totally encloses the cards when the container is in the closed box configuration like any box holding a deck of playing cards. In the open configuration, the container supports the set of cards for display on a desk or other horizontal surface. When the cards are displayed in the container, the face of the top card is visible to provide information for one calendar week.

A particular advantage of the card calendar of the present invention is that it includes a container which can serve to enclose and protect the cards during storage and to support the cards during usage as a calendar. Another advantage of the disclosed card calendar is that it contains a set of cards in which each card includes indicia for one week of the calendar year as well as playing card indicia. A further advantage of the card calendar is that it is of a size and construction which can be easily carried in a pocket or brief case, and can be used as a promotional or advertising item.

BRIEF DESCRIPTION OF THE DRAWING

Further objects of the present invention will become apparent from the following description of the preferred embodiments with reference to the accompanying drawing in which.

DESCRIPTION OF THE PREFERRED EMBODIMENTS

Figure 1:
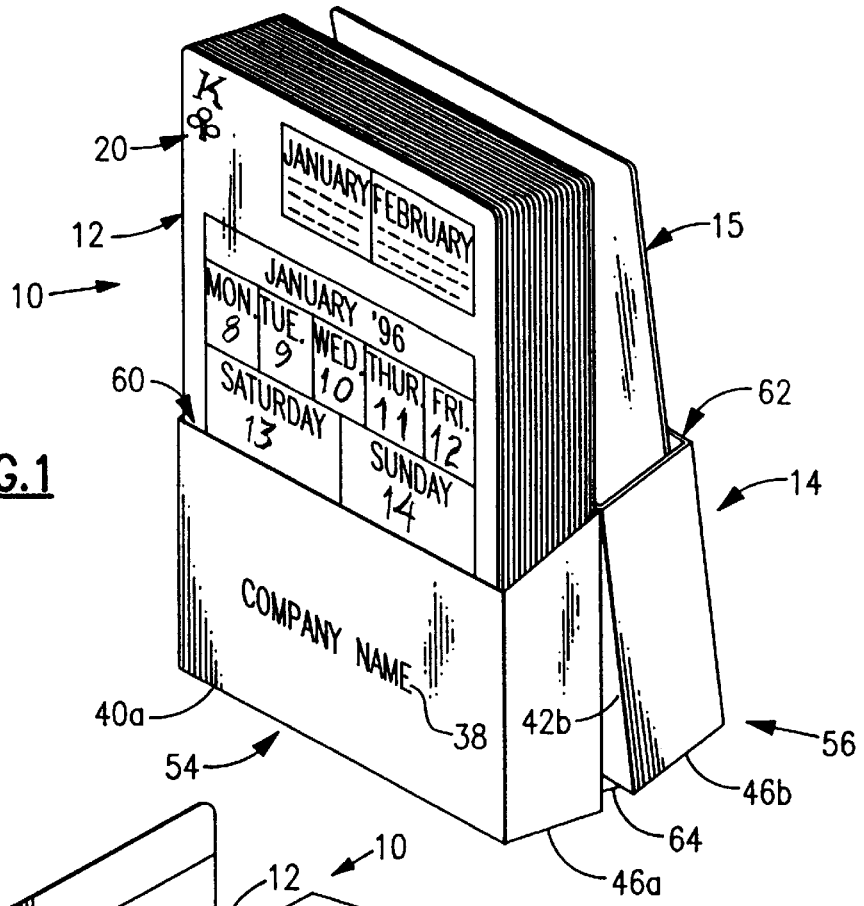
FIG. 1 is a perspective view of the card calendar of the present invention, with the container for the cards shown in the open position.
Figure 2:
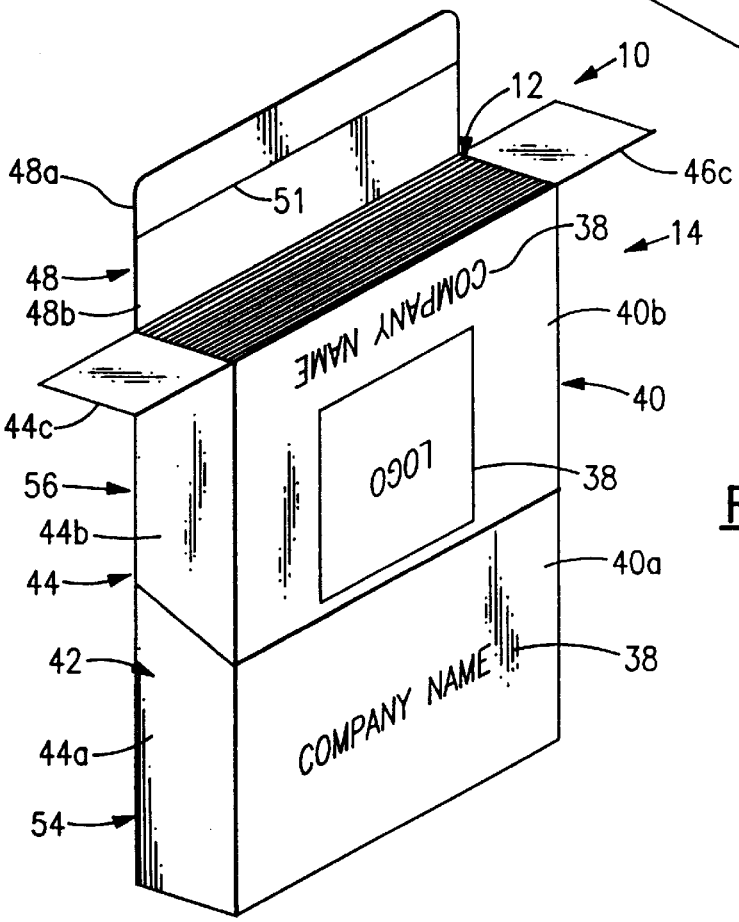
FIG. 2 is a perspective view of the card calendar of the present invention with the container for the cards shown in a substantially closed position.

With reference to FIG. 1, there is shown a card calendar 10 constructed in accordance with the present invention. Calendar 10 comprises a set of cards 12 which are supported in a container 14. As will become apparent hereinafter, container 14 provides a convenient means for storing and displaying cards 12. As shown in FIGS. 1 and 2, container 14 can be converted from an open display case configuration (See FIG. 1) to a closed storage box configuration (See FIG. 2).

In a preferred embodiment of the present invention, the set of cards 12 for calendar 10 displays calendar information in a weekly format, and it also forms a deck of playing cards. The set of cards 12 contains fifty-two cards 15, one card for each week of the calendar year and for each card in a standard deck of playing cards (e.g., a poker deck).

Figure 3:
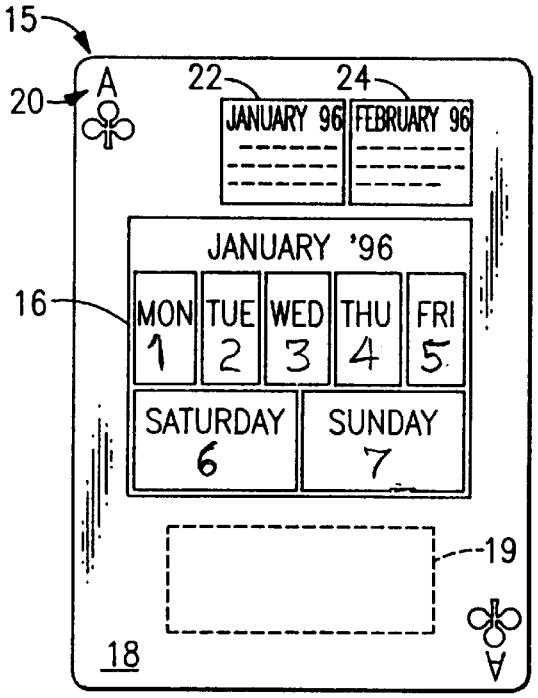
FIG. 3 is a view of the face side of a card for use in the present invention.

As shown in FIG. 3, each of the cards 15 contains a block 16 on a face side 18 of the card which displays the dates for the seven days of a week, in a particular month of a year. Also contained on the face side 18 are blocks 22 and 24 which display the current calendar month and the next calendar month, respectively. It will be apparent that other calendar information could be included on face side 18, for example, a block containing the month preceding the current month. It would also be possible to include more or less than seven dates on a particular card as long as the number of cards is held to fifty-two cards.

In addition to the calendar information, face side 18 contains indicia defining a particular playing card, for example, indicia for the Ace of Clubs as shown at 20 in FIG. 3. As is well known, a deck of playing cards contains four suits: hearts, diamonds, clubs, and spades, and in each suit there are 13 cards. In a preferred arrangement, all of cards 15 in a suit would be grouped together in the set of cards 12 so that one suit would represent, for example, one quarter of the year. Within each suit, cards 15 could be arranged according to rank, that is, ace, king, queen, jack, and 10 through 2. The weeks for that particular calendar quarter would follow this ranking. Such an arrangement would make it easy to reassemble the cards in calendrical (or chronologic) sequence after use as playing cards.

Figure 4:
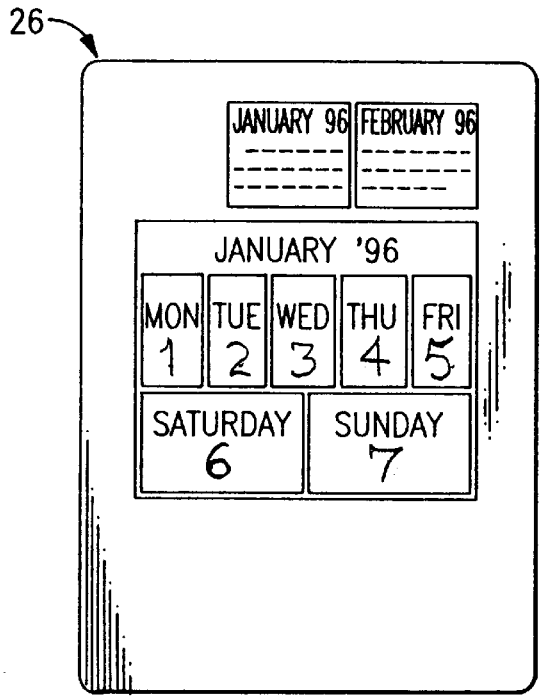
FIG. 4 is a view of the face side of another card for use in a second embodiment of the present invention.

In FIG. 4, there is shown a card 26 which can be used in a second embodiment of the present invention. Card 26 is substantially identical to card 15, with the exception that it does not contain playing card indicia. Cards 15 and 26, can be of any convenient size, and are preferably of a size typically assumed by standard playing cards. The cards 15 can be of any desired thickness, but preferably of a thickness and material so that the cards are somewhat flexible, but durable. Cards 15 and 26 can be made from paper, cardboard, plastic or any other material for making a durable construction. For example, cards 15 and 26 may be constructed of 2 ply, 10.5 point, plastic coated card stock.

Figure 5:
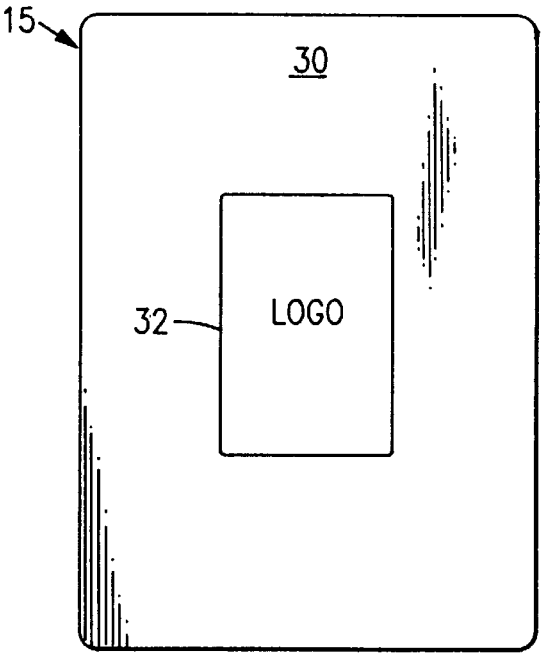
FIG. 5 is a view of the back side of the card shown in FIG. 3.

Calendar 10 of the present invention is particularly suitable as a medium for advertising or promotion. When calendar 10 is used for this purpose, a back face 30 of cards 15 can contain advertising or promotional matter, for example, a company logo 32, as shown on card 15 in FIG. 5. Face side 18 may further contain advertisement or promotional matter, such as a company name or logo 19 (shown in phantom lines).

Figure 6:
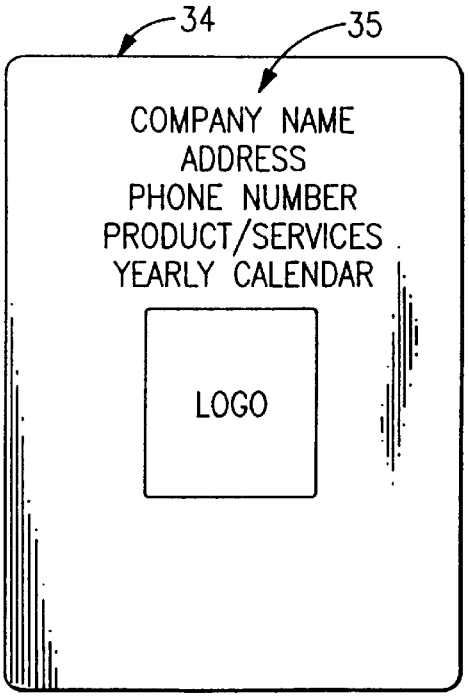
FIG. 6 is a view of the face side of another card for use as a special page or card in the present invention.

Referring to FIG. 6, there is shown a special card 34 containing indicia 35 which may include advertising or promotional information such as, for example, a company's name and/or logo, company address, telephone numbers, plant locations, product or service descriptions, or order forms for more calendar cards. Indicia 35 may also include reference information such as a tips chart, yearly calendar, important dates, important personal dates (e.g., a user records birthdays, anniversaries, etc.), phone numbers, car care reminders, etc. The size of card 34 may be the same size as card 15 or card 26, or any other suitable size. It is contemplated that card 34 could be carried in a pocket, wallet, purse, personal organizer, etc. Card 34 may be referred to as a "special page" or "special card" to distinguish it from calendar cards 15. Card 34 may also contain advertising or promotional matter on its back side (not shown).

Figure 7:
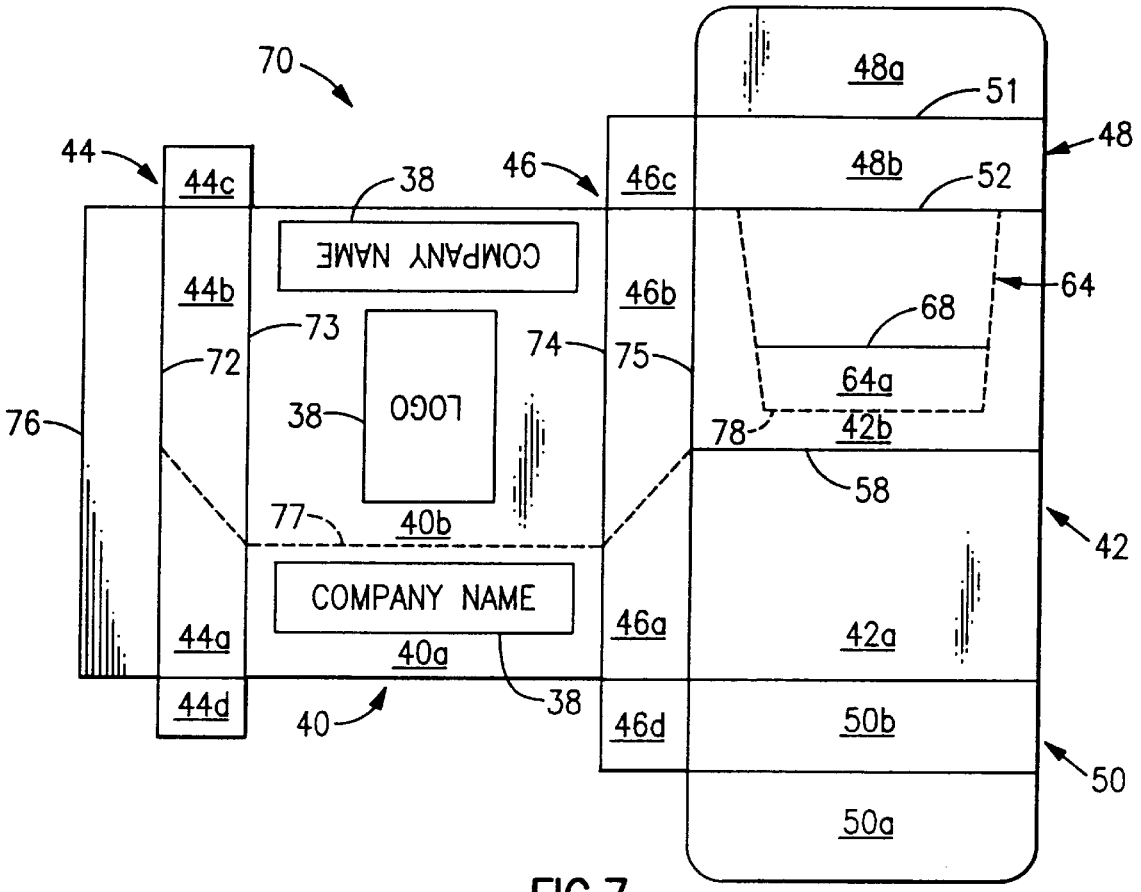
FIG. 7 is a view of a blank which can be used in assembling the container for the cards in the calendar of the present invention.

As shown in FIGS. 2 and 7, container 14 comprises a front panel 40, a rear panel 42, a pair of side panels 44 and 46, and a pair of end panels 48 and 50. Advertising indicia 38 is included on front panel 40 and is oriented such that it will be righted (i.e., upright) when container 14 is in the open configuration. Front panel 40 is defined by two panel portions 40*a* and 40*b*; rear panel 42 is defined by two panel portions 42*a* and 42*b*; side panels 44 and 46 are defined by panel portions 44*a*, 44*b*, 44*c*, 44*d* and by panel portions 46*a*, 46*b*, 46*c*, 46*d* respectively; and end panels 48 and 50 are defined by panel portions 48*a*, 48*b* and 50*a*, 50*b* respectively. As shown in FIG. 7, end panel 48 contains a fold line 51 which divides portions 48*a* and 48*b*. Panel 48 is divided from rear panel 42 by a second fold line 52. Panel 50 is similarly divided along fold lines. At some point in the construction of container 14, side panel portions 46*c* and 46*d* are separated from end panel portions 48*b* and 50*b* respectively, along their adjoining sides.

As shown in FIG. 1, container 14 is fully assembled, and in the open, display case configuration. In this configuration, container 14 may be described as having a card display holder 54 and a card storage holder 56. Holder 54 comprises: front panel portion 40*a*; rear panel portion 42*a*; side panel portions 44*a*, 44*d*, 46*a*, and 46*d*; and end panel 50. Holder 56 comprises: front panel portion 40*b*; rear panel portion 42*b*; side panel portions 44*b*, 44*c*, 46*b*, and 46*c*; and end panel 48. Holders 54 and 56 are joined together at a fold line 58 (See FIG. 7) which operates as a hinge. The hinge created by fold line 58 allows one to adjust the position of one holder relative to the other holder about hinge line 58.

As shown in FIG. 1, holder 54 contains a card display stall 60 for receiving and displaying cards 15, 26 and 34. Holder 56 contains a card storage stall 62 for receiving and storing cards 15 and 26, for example, after the weeks they represent have passed. This use of stall 62 is illustrated in FIG. 1. Card 15 was originally displayed in stall 60 at the front of card stack 12, during the week represented by card 15. Card 15 was then placed in stall 62 after such week had passed.

Figure 8:
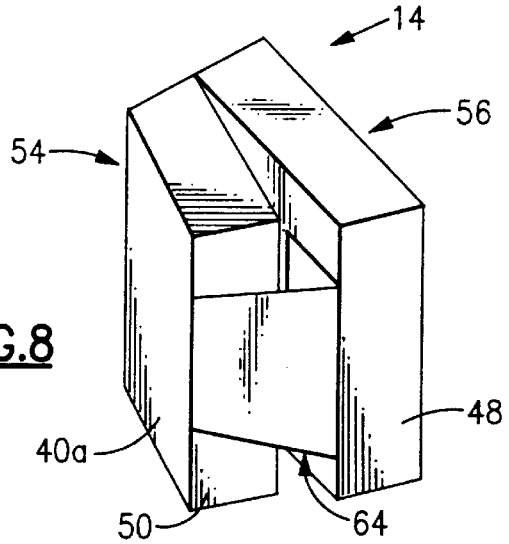
FIG. 8 is a perspective view of the container for the cards, showing a tab for securing the container in the open position.

In the preferred embodiment, holders 54 and 56 are coupled to one-another by means of a tab 64, as shown in FIGS. 1, 7 and 8. This coupling is best shown in FIG. 8. As shown in FIG. 7, tab 64 includes an tip portion 64*a* which is folded along a fold line 68. To complete the conversion of container 14 to the open display case configuration, tip portion 64*a* is inserted into the bottom of holder 54, between front panel portion 40*a* and end panel 50 (See FIG. 8).

In order to convert container 14, as shown in FIG. 2, to the fully closed storage box configuration, the following procedure is performed: side flaps 44*c* and 46*c* are folded over toward the interior of container 14; end panel 48*b* and tab 48*a* are folded over side flaps 44*c* and 46*c*; and tab 48*a* is inserted into container 14, between set of cards 12 and the top of front panel 40*b*.

Container 14 may be assembled from a blank 70, as shown in FIG. 7. Blank 70 can be made from any suitable durable material as discussed previously. As shown in FIG. 7, blank 70 contains fold lines 72–75 which permit the folding of side panels 44, 46 and front and rear panels 40, 42, along these lines. After blank 70 has been folded along lines 72–75, a fixing tab 76, integrally formed with side panel 44, is affixed to the rear side (i.e., the side facing into the paper in FIG. 7) of rear panel 42 by means of a suitable adhesive. This completes the basic assembly of container 14.

With further reference to FIG. 7, a die cut perforation line 77 extends through side panels 44, 46 and front panel 40. Perforation line 77 divides front panel portions 40*a* and 40*b*, side panel portions 44*a* and 44*b*, and side panel portions 46*a* and 46*b*. When panels 44, 46, and 40 are severed along perforation line 77, the completely assembled container 14 can be opened to form holders 54 and 56, as shown in FIG. 1. This procedure will be further described hereinbelow. With further reference to FIG. 7, a second die cut perforation line 78 defines tab 64 on rear panel portion 42*b*. Tab 64 is broken out of rear panel portion 42*b* and used to couple holder 56 to holder 54 as described above.

Calendar 10 would normally be packaged and sold to clients with perforation lines 77 and 78 unbroken, so that cards 12 have maximum protection until use. In preparing calendar 10 for use as, for example, a desk-top calendar, the user would first open bottom flap 50 of container 14, remove set of cards 12, and reclose flap 50. Next, perforation lines 77 and 78 would be severed. Holder portion 56 (or "the flip top") would then be folded back over fold line 58 to a position shown in FIG. 1. Tip portion 64*a* of tab 64 would then be inserted into holder 54, between front panel portion 40*a* and flap portion 50*a*. After completion of this step, container 14 would be in the open display case configuration shown in FIGS. 1 and 8. In this configuration, set of cards 12 can be inserted into display stall 60 of holder 54, calendar side out, for displaying weekly calendar information. When a week has passed, the outdated card 15 is pulled from stall 60 and inserted into storage stall 62 of holder 56 (See FIG. 1).

With the card calendar of the present invention, it is to be noted that the advertiser or promoter receives exposure of its message on both the front and back of container 14 (when in the open display case configuration), as well as on the back (and/or front) of each card 15, 26 and/or 34.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What is claimed is:

1. A card calendar for displaying the days of the year one week at a time, said calendar comprising:

a deck of 52 playing cards, each of said cards having indicia on a face side thereof indicating suit and rank of the card;

weekly calendar indicia on the face side of each of said cards indicating the days of the week and dates for each of the days of a particular week in a calendar year, said cards being arranged in said deck such that successive cards display the weeks of the year in chronological sequence; and a special card containing on the face thereof indicia other than said weekly calendar indicia.

* * * * *